US007311519B2

(12) United States Patent
Shima et al.

(10) Patent No.: US 7,311,519 B2
(45) Date of Patent: Dec. 25, 2007

(54) RAW MATERIAL FEEDING APPARATUS FOR ROTARY HEARTH FURNACE

(75) Inventors: Shinji Shima, Kitakyushu (JP); Yuichi Sakurai, Kitakyushi (JP); Masahide Nagatomi, Kitakyushu (JP)

(73) Assignees: Nippon Steel Corporation, Tokyo (JP); Nittetsu Plant Designing Corporation, Fukuoka (JP)

( * ) Notice: Subject to any disclaimer, the term of this patent is extended or adjusted under 35 U.S.C. 154(b) by 136 days.

(21) Appl. No.: 10/535,903

(22) PCT Filed: Nov. 21, 2003

(86) PCT No.: PCT/JP03/14944

§ 371 (c)(1),
(2), (4) Date: May 20, 2005

(87) PCT Pub. No.: WO2004/048869

PCT Pub. Date: Jun. 10, 2004

(65) Prior Publication Data

US 2006/0035193 A1 Feb. 16, 2006

(30) Foreign Application Priority Data

Nov. 22, 2002 (JP) ..... 2002-339370

(51) Int. Cl.
*F27B 9/18* (2006.01)

(52) U.S. Cl. ..... 432/239; 432/118; 414/588; 266/176

(58) Field of Classification Search ..... 432/87, 432/105, 117, 118, 124, 195, 239; 414/588, 414/160, 162, 586, 587; 241/181–183; 266/176
See application file for complete search history.

(56) References Cited

U.S. PATENT DOCUMENTS 5,895,215 A 4/1999 Rinker et al.
6,164,891 A * 12/2000 De Marchi et al. ..... 414/160
6,210,155 B1 * 4/2001 Bernard et al. ..... 432/124
6,406,662 B1 * 6/2002 Molnar et al. ..... 266/176

(Continued)

FOREIGN PATENT DOCUMENTS

BE 1006456 A6 9/1994

(Continued)

OTHER PUBLICATIONS

"Jidoka Books (1) Handling no Jidoka Zushu", Yozo Fujimori, (Showa 51-4-1), Kabushiki Kaisha Taiga Shuppan, p. 14, Fig. 8, pp. 25-26, 29, 34.

*Primary Examiner*—Gregory Wilson
(74) *Attorney, Agent, or Firm*—Kenyon & Kenyon LLP

(57) ABSTRACT

The invention provides a raw materials feeding apparatus capable of uniformly dispersing and feeding into a furnace agglomerated raw materials that are likely to undergo dusting, deformation and mutual adhesion. In a raw material feeding apparatus for a rotary hearth furnace, for feeding raw materials to a rotary hearth furnace by using a flat belt conveyor, the invention employs a construction in which a scraper for guiding the raw materials on the flat belt conveyor to a side surface of the flat belt conveyor is arranged obliquely to a traveling direction of the flat belt conveyor. Preferably, the scraper is arranged in such a manner as to guide the raw materials to both sides of the flat belt conveyor.

6 Claims, 5 Drawing Sheets

U.S. PATENT DOCUMENTS

| | | | | |
|---|---|---|---|---|
| 2001/0034003 | A1* | 10/2001 | Wellmann | 432/118 |
| 2004/0202979 | A1* | 10/2004 | Ishiwata et al. | 432/195 |

FOREIGN PATENT DOCUMENTS

| | | |
|---|---|---|
| JP | 45-19569 | 7/1970 |
| JP | 51-20377 | 2/1976 |
| JP | 4-37122 | 3/1992 |
| JP | 11012621 | 1/1999 |
| JP | 11-322039 | 11/1999 |
| JP | 11-337265 | 12/1999 |
| JP | 2000-247435 | 9/2000 |

* cited by examiner

RAW MATERIAL FEEDING APPARATUS FOR ROTARY HEARTH FURNACE

TECHNICAL FIELD

This invention relates to a pellet-feeding apparatus for a rotary hearth furnace, for feeding raw material to a rotary hearth furnace by using a flat belt conveyor.

More concretely, the invention relates to a raw material-feeding apparatus feeding raw materials to a rotary hearth furnace for mainly producing reduced iron by using an iron ore or the wastes of iron making.

BACKGROUND ART

A rotary hearth furnace is a movable hearth furnace for heating and reducing metal oxides such as iron ore or the wastes of iron making, and a rotary hearth furnace, the hearth of which is a horizontal surface and rotates, is known from Japanese Examined Patent Publication (Kokoku) No. 45-19569, and so forth.

The raw-material processed inside this rotary hearth furnace is, in advance, agglomerated and is charged into the rotary hearth by a charging device provided at an upper part of the furnace. Because an outer peripheral portion of the rotary hearth has a greater area than its inner peripheral portion, however, contrivances are required so as to uniformly disperse the raw materials on the entire surface of the rotary hearth. Therefore, a vibration conveyor and a swivel conveyor have been used in the past for this uniform dispersion charging device.

Japanese Unexamined Patent Publication (Kokai) No. 11-293317, for example, discloses a mechanism for charging a pellet (hereinafter called "raw material") into a rotary hearth furnace, having the construction in which a plurality of screens for dividedly guiding the pellets is arranged in a trough of a vibration conveyor for charging the pellet to the rotary hearth furnace and uniformly charges the pellets into the rotary hearth furnace by adjusting openings of passages partitioned by these screens.

Japanese Unexamined Patent Publication (Kokai) No. 11-337265 discloses a mechanism for uniformly charging the pellets into the rotary hearth furnace by adjusting a swivel speed in accordance with a position of a pivot of the swivel conveyor.

However, the agglomerated raw material has various properties such as low strength, brittleness, easy adhesion, etc, depending of the condition of the raw material, formation method and water content. Therefore, the conventional method or the method using the vibration conveyor, for example, is not able to satisfy the charging function itself because it invites dusting, deformation and mutual adhesion, by the application of vibration to the agglomerated raw material.

The swivel conveyor has theoretically only a function of charging the raw material onto the swivel orbit and is a system that cannot uniformly disperse and charge the pellet.

DISCLOSURE OF THE INVENTION

To solve the problems of the prior art technologies described above, the invention provides a raw material-feeding apparatus capable of uniformly dispersing, and feeding into a furnace, an agglomerated raw material that is likely to undergo dusting, deformation and mutual adhesion. Concretely, the invention is directed to the following points.

1) To employ a mechanism that minimizes the impact applied to a agglomerated raw material.

2) To feed the agglomerated raw material on a continuous line.
3) To feed the agglomerated raw material into a rotary hearth furnace without interruption.

The invention was completed as a result of intensive studies for solving the problems described above and provides a raw-material-feeding apparatus for a rotary hearth furnace, for feeding a raw material to a rotary hearth furnace capable of uniformly dispersing and feeding a agglomerated raw material that is likely to undergo dusting, deformation and mutual adhesion, into a furnace by obliquely disposing a scraper for guiding the raw-material on the flat belt conveyor to a side surface of the flat belt conveyor with respect to a traveling direction of the flat belt conveyor. The gist of the invention is described in the Scope of Claim for Patent.

(1) A raw material-feeding apparatus for a rotary hearth furnace, for feeding a raw material to a rotary hearth furnace by using a flat belt conveyor, characterized in that a scraper for guiding the raw material on the flat belt conveyor to a side surface of the flat belt conveyor is arranged obliquely to a traveling direction of the flat belt conveyor.
(2) A raw material-feeding apparatus for a rotary hearth furnace described in (1), wherein the scrapers for guiding the raw material on the flat belt conveyor to the side surface of the flat belt conveyor are disposed on both sides of the flat belt conveyor.
(3) A raw material-feeding apparatus for a rotary hearth furnace described in (1) or (2), wherein a gap between entrance portions of the scraper for guiding the raw material on the flat belt conveyor to the side surface of the flat belt conveyor is adjustable.
(4) A raw material-feeding apparatus for a rotary hearth furnace described in (1) or (2), wherein the scraper for guiding the raw materials on the flat belt conveyor to the side surface of the flat belt conveyor is shaped into a curve shape.
(5) A raw material-feeding apparatus for a rotary hearth furnace described in any of (1) to (4), wherein the raw material is charged in one layer onto the flat belt conveyor.
(6) A raw material-feeding apparatus for a rotary hearth furnace described in any of (1) to (4), wherein the raw material is charged in two to five layers onto the flat belt conveyor.

BRIEF DESCRIPTION OF THE DRAWINGS

FIG. 2(*b*) is a perspective view showing a raw material-feeding apparatus for a rotary hearth furnace according to the embodiment of the invention in which the scraper is so arranged as to guide the raw material to one of the sides of a flat belt conveyor.

FIG. 3(*b*) is a perspective view showing a raw material-feeding apparatus for a rotary hearth furnace according to the embodiment of the invention in which the scraper is so arranged as to guide the raw material to both sides of the flat belt conveyor.

FIG. 4(*b*) is a perspective view showing an embodiment of the invention wherein the drop chute of the raw material-feeding apparatus for a rotary hearth furnace according to the invention operates also as the cutoff plate for preventing the fall of raw materials.

FIG. 5(*b*) is a perspective view showing the raw material-feeding apparatus for a rotary hearth furnace according to the invention wherein the scraper has a curve surface.

BEST MODE FOR CARRYING OUT THE INVENTION

Embodiments of the invention will be explained in detail with reference to FIGS. 1 to 6.

Figure 1:
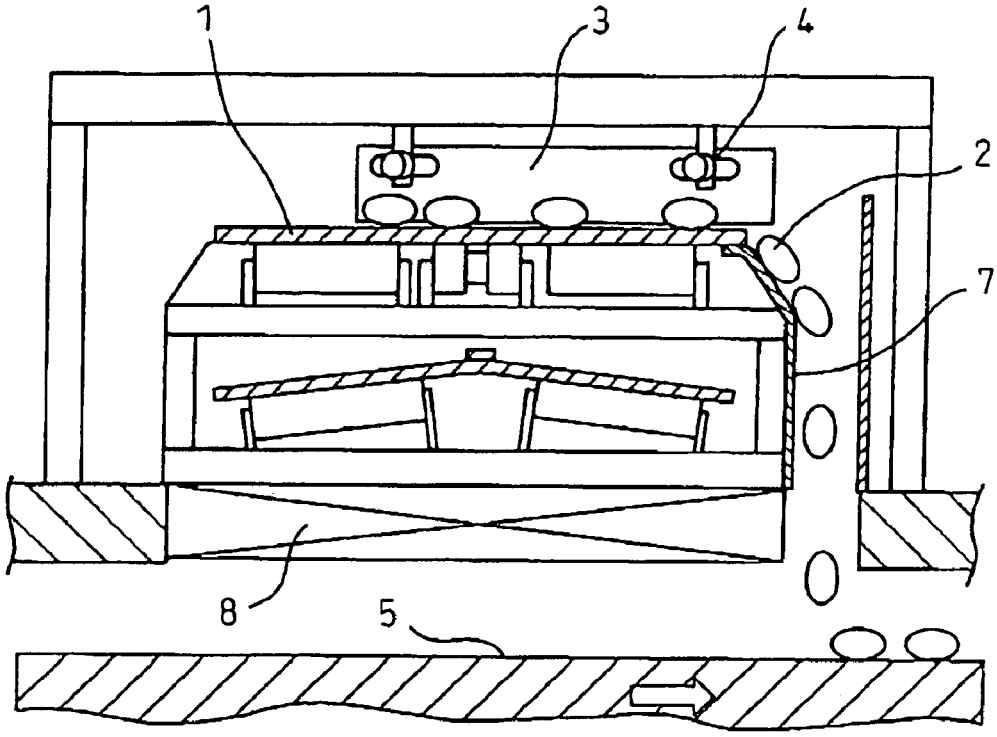
FIG. 1 shows a raw material-feeding apparatus for a rotary hearth furnace according to an embodiment of the invention.

FIG. 1 shows a raw material-feeding apparatus for a rotary hearth furnace according to an embodiment of the invention.

Referring to FIG. 1, reference numeral 1 denotes a flat belt conveyor. Reference numeral 2 denotes a raw material. Reference numeral 3 denotes a scraper. Reference numeral 4 denotes an entrance gap adjustment mechanism. Reference numeral 5 denotes a rotary hearth. Reference numeral 7 denotes a falling raw material cutoff plate. Reference numeral 8 denotes heat insulating structure.

The pellet 2 fed to the flat belt conveyor 1 is guided by the scraper 3 to a side surface of the flat belt conveyor 1 and falls onto the rotary hearth 5.

Though a small gap is shown secured between the scraper 3 and the flat belt conveyor 1, this gap need not always be secured.

The invention can convey the raw material without imparting impact thereto because the invention employs the flat belt conveyor 1.

The materials of the conveyor belt of the flat belt conveyor 1 are of a polymer type such as rubber, or a metal, and preferably have high heat resistance.

In the embodiment shown in FIG. 1, the lower surface of a carrier of the flat belt conveyor 1 is supported by rollers aligned densely but may be supported by flat plates in place of the rollers.

Crown pulleys or an apparatus having a zigzag movement prevention function such as rollers having the V guides shown in FIG. 1 are preferably provided to the flat belt conveyor 1.

To avoid radiation heat from inside the furnace to the flat belt conveyor 1, the heat insulating structure 8 or a water cooling structure is preferably provided to the bottom of the flat belt conveyor 1.

Figure 2A:
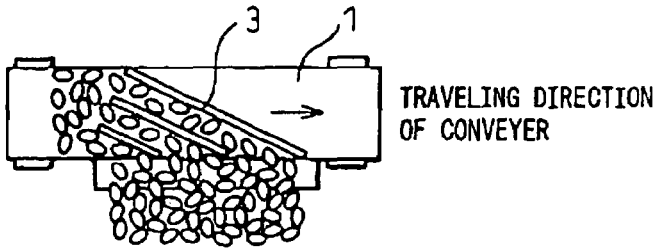
FIG. 2(*a*) is a plan view showing a raw material-feeding apparatus for a rotary hearth furnace according to the embodiment of the invention in which a scraper is so arranged as to guide the raw material to one of the sides of a flat belt conveyor.
Figure 2B:
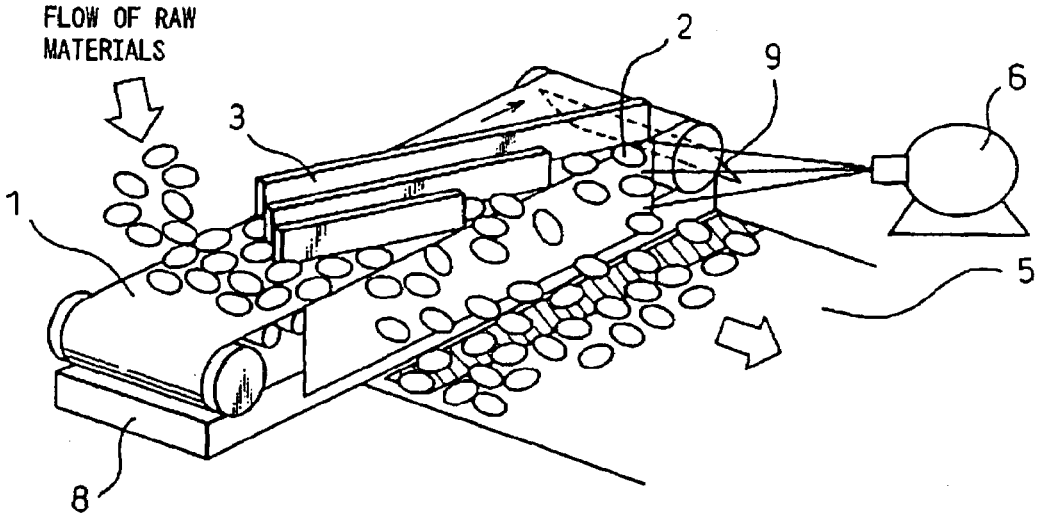

FIGS. 2(*a*) and 2(*b*) show a raw material feeding apparatus for a rotary hearth furnace according to the invention, wherein the scraper of the invention is disposed on one of the sides of the flat belt conveyor. FIG. 2(*a*) is a plan view and FIG. 2(*b*) is a perspective view.

Referring to FIGS. 2(*a*) and 2(*b*), reference numeral 1 denotes the flat belt conveyor. Reference numeral 2 denotes the raw materials. Reference numeral 3 denotes the scraper. Reference numeral 5 denotes the rotary hearth. Reference numeral 6 denotes a fan. Reference numeral 7 denotes the falling raw materials prevention cutoff plate. Reference numeral 8 denotes the heat insulating structure. Reference numeral 9 denotes a cleaner.

The raw materials 2 fed to the flat belt conveyor 1 slides in the side surface direction of the flat belt conveyor 1 while being guided by the scraper 3 arranged obliquely relative to the traveling direction of the flat belt conveyor 1 and falls onto the rotary hearth 5.

The raw materials slide gently and transversely to the side surface direction of the flat belt conveyor 1 along the scraper 3.

The raw materials reaching the side surface of the flat belt conveyor falls serially and continuously from the belt and a continuous and uniform feed becomes possible on a continuous line.

Figure 6:
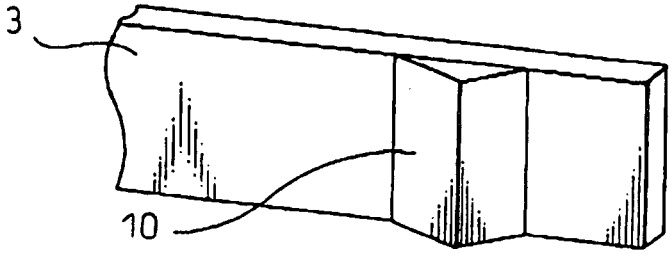
FIG. 6 shows adjustment projections used in an embodiment of the invention.

To prevent sticking of the raw materials 2, adjustment projections 10 for correcting and adjusting uniform dispersion of the raw materials are preferably disposed on the surface of the scraper 3 on which the raw material flows, as shown in FIG. 6. The adjustment projections 10 can be applied to the embodiments shown in FIGS. 3(*a*) and 3(*b*) and FIGS. 4(*a*) and 4(*b*), too.

Though a plurality of scrapers 3 is disposed in the embodiment, the scraper 3 may be a single scraper.

When the raw material is likely to undergo deformation or to adhere, it is preferred to reduce mutual bonding power at the time of transverse sliding by disposing a plurality of scrapers 3. A single scraper not having the feed line is preferable when large variance exists in the size of the raw material.

To prevent deformation and adhesion of the raw material, polymer type rubber, resins such as Teflon (trade mark) and metal materials having high wear resistance (stainless steel, etc) are individually used as the material of the scraper 3, or can be bonded to the scraper 3 to form a multi-layered material.

The falling raw material prevention cutoff plate 7 is disposed to prevent the falling raw material from the carrier surface of the flat belt conveyor 1 down to the inside. However, a drop chute may operate as the cutoff plate 7 for preventing the falling raw material.

To prevent overheat of the flat belt conveyor 1, cooling air is preferably blown by the fan 6, etc, into the space sandwiched between the carrier surface of the flat belt conveyor 1 and a return surface.

The cleaner 9 for scraping off and removing adhering matters to the belt is preferably disposed downstream of the flat belt conveyor 1.

The belt speed of the flat belt conveyor 1 is preferably variable in order to control the feed amount of the raw material, to adjust the thickness of the raw material layer on the belt and to uniformly disperse the pellet.

When the raw material is dividedly charged by using a plurality of scrapers 3, the gaps of the entrance portion of the scrapers 3 is preferably adjustable. When the entrance gaps are adjustable, the feed amount of each line becomes adjustable.

The gap of the entrance portion of the scraper 3 is preferably adjusted by fixing the scraper 3 by an elongated hole and changing the installation position of the scraper 3 as the entrance gap adjustment mechanism 4 shown in FIG. 1. This entrance gap adjustment mechanism 4 can be applied to the embodiments shown in FIGS. 3(*a*) and 3(*b*) and FIGS. 4(*a*) and 4(*b*).

When the gap of the entrance portion of the scraper for feeding the raw materials to the outer peripheral portion of the rotary hearth is made grater than that of the entrance portion of the scraper for feeding the raw materials to the inner peripheral portion by utilizing this mechanism 4, a greater amount of the raw materials can be fed to the outer peripheral portion having a greater area and a difference in the feed amount resulting from the area difference between the inner and outer circumferences of the rotary hearth can be corrected.

Figure 3A:
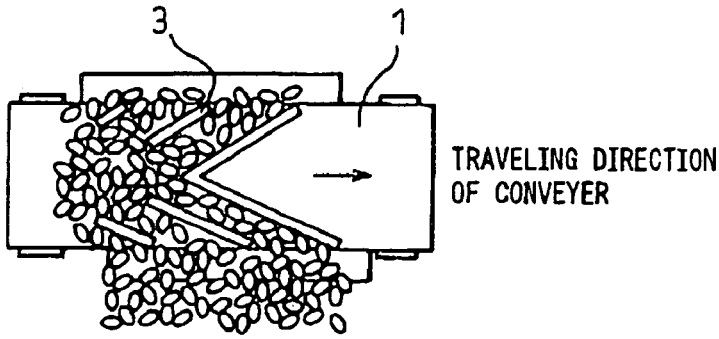
FIG. 3(*a*) is a plan view showing a raw material-feeding apparatus for a rotary hearth furnace according to the embodiment of the invention in which the scraper is so arranged as to guide the raw material to both sides of the flat belt conveyor.
Figure 3B:
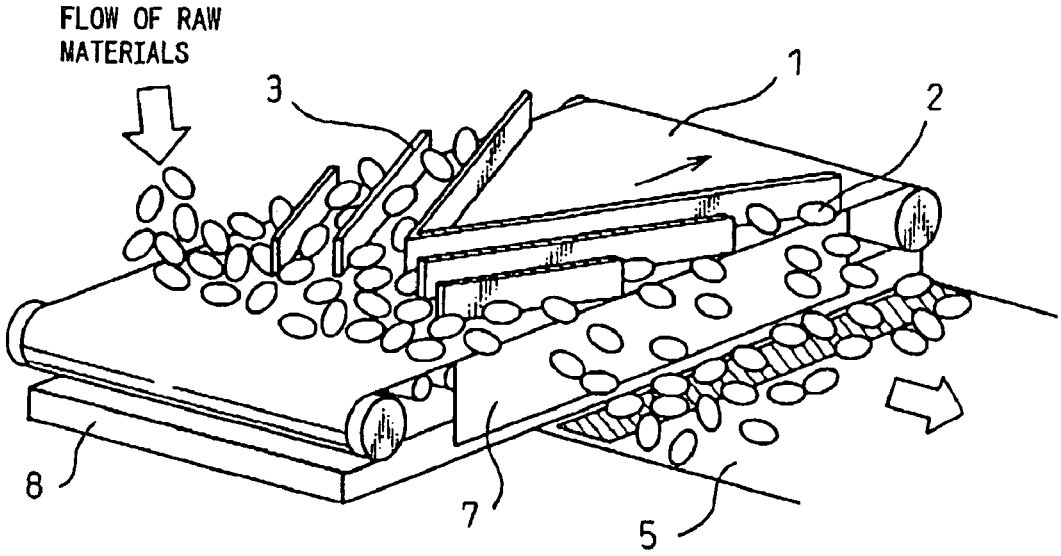

FIGS. 3(*a*) and 3(*b*) show a raw material-feeding apparatus for a rotary hearth according to another embodiment of the invention, wherein the scrapers of the invention are disposed on both sides of the flat belt conveyor. FIG. 3(*a*) is a plan view and FIG. 3(*b*) is a perspective view.

Referring to FIGS. 3(*a*) and 3(*b*), reference numeral 1 denotes the flat belt conveyor. Reference numeral 2 denotes the raw materials. Reference numeral 3 denotes the scraper. Reference numeral 5 denotes the rotary hearth. Reference numeral 6 denotes the fan. Reference numeral 7 denotes the falling raw material prevention cutoff plate. Reference numeral 8 denotes the heat insulating structure.

As the scrapers 3 are disposed on both sides of the flat belt conveyor 1 in this embodiment, the raw materials are allowed to fall from both side surfaces of the flat belt conveyor 1 and can be fed to the rotary hearth 5.

In this case, the uniform dispersion charging effect of the raw material can be improved by alternately arranging the entrance positions of the right and left scrapers.

Figure 4A:
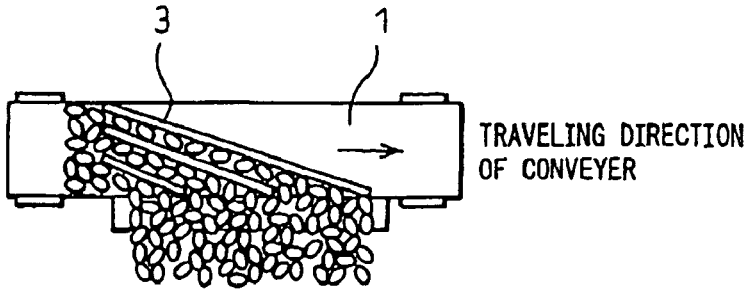
FIG. 4(*a*) is a plan view showing an embodiment of the invention wherein a drop chute of the raw material feeding apparatus for a rotary hearth furnace according to the invention operates also as a cutoff plate for preventing the fall of raw materials.
Figure 4B:
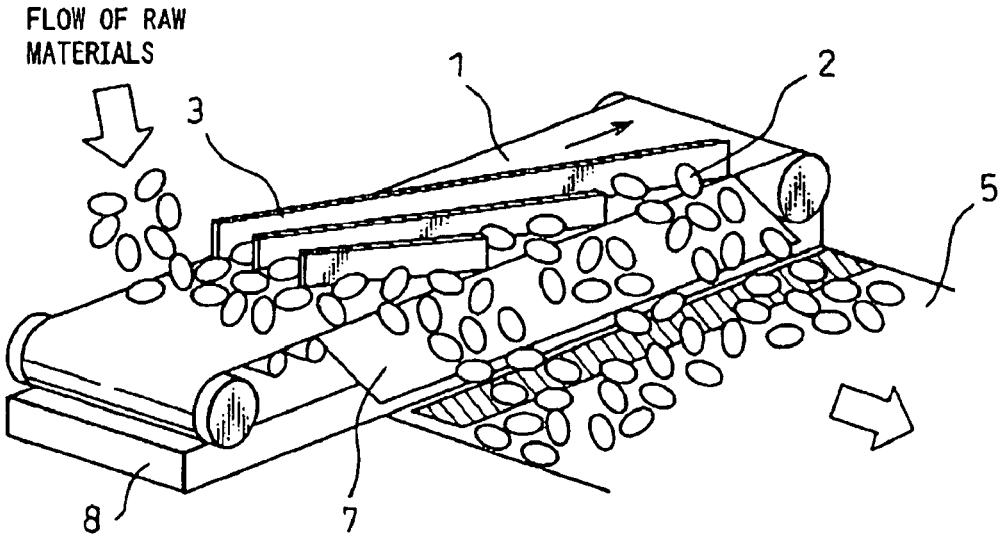

FIGS. 4(*a*) and 4(*b*) shows another embodiment, wherein the drop chute of the raw material-feeding apparatus for a rotary hearth in the invention is allowed to operate as the cutoff plate for preventing the falling raw material. FIG. 4(*a*) is a plan view and FIG. 4(*b*) is a perspective view.

The falling raw material prevention cutoff plate 7 shown in FIGS. 4(*a*) and (*b*) is inclined and has the function of a drop chute of the raw material, too.

Figure 5A:
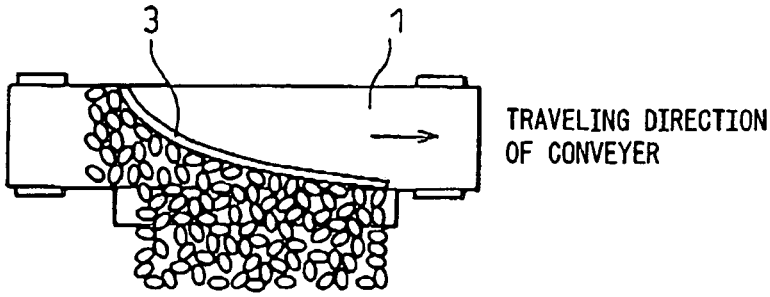
FIG. 5(*a*) is a plan view showing a raw material-feeding apparatus for a rotary hearth furnace according to the invention wherein a scraper has a curve surface.
Figure 5B:
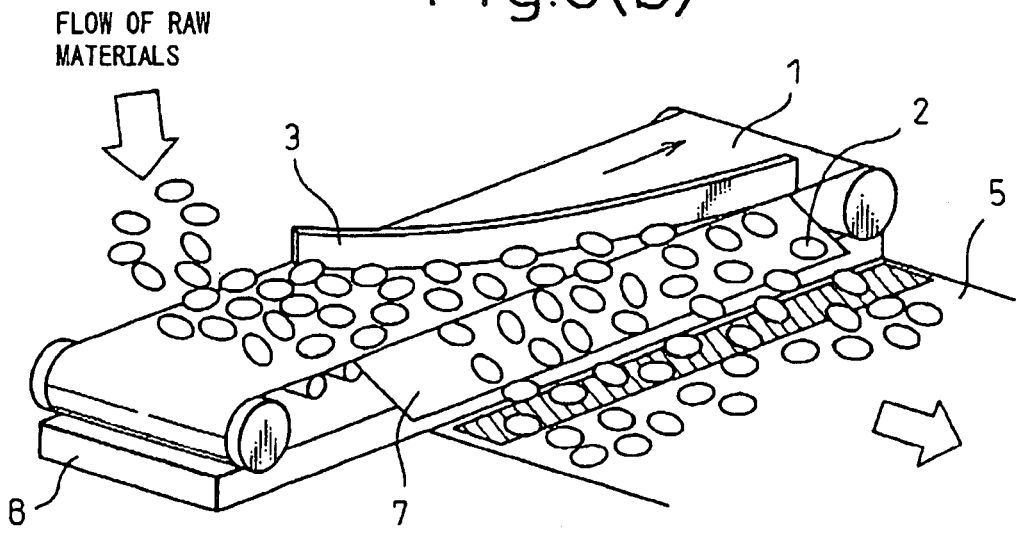

When the raw material is charged by using one scraper 3 (two scrapers for the feed from both ends of the belt), the feed amount of the pellet can be adjusted by shaping the scraper 3 into the curve shape shown in FIGS. 5(*a*) and 5(*b*). When this scraper 3 is used, a greater amount of the raw material can be fed to the outer periphery of the rotary hearth than to the inner periphery. Consequently, deviation of the feed amount resulting from the area difference between the inner and outer peripheries of the rotary hearth can be corrected.

Incidentally, in the embodiments shown in FIGS. 2(*a*) and 2(*b*) to FIGS. 5(*a*) and 5(*b*), the raw material 2 may be charged as a single layer into the flat belt conveyor 1 but when the raw material 2 is charged in two to five layers, the raw material 2 can be uniformly dispersed.

When the raw material 2 is charged in the single layer onto the flat belt conveyor 1, the raw material 2 can be uniformly dispersed into the furnace after it is charged onto the conveyor. When any gaps exist among the raw materials, however, the raw materials cannot be dispersed uniformly in some cases because only the gaps become smaller and non-uniformity of the raw materials occurs on the side of the scraper surface.

Therefore, when the raw materials 2 in two or more layers is charged onto the conveyor, the layers of raw materials bury the gaps. Consequently, the gaps do not occur among the raw materials but the raw material can be uniformly dispersed and charged into the furnace.

When the number of layers exceeds five layers, on the other hand, the width capable of uniformly dispersing the raw material does not change even when the raw material 2 is charged onto the conveyor. It is therefore preferred to charge the raw materials in the range of two to five layers.

INDUSTRIAL APPLICABILITY

The invention can provide a raw material-feeding apparatus capable of uniformly dispersing and feeding into a furnace raw materials that is likely to undergo dusting, deformation and mutual adhesion. Because ① the invention minimizes the impact to the agglomerated raw material, ② can feed the agglomerated raw material on the continuous line and ③ can feed the agglomerated raw material into the rotary hearth furnace without interruption, the invention provides the following industrially remarkable effects.

1) The agglomerated raw material dust is not fed into the furnace, and the loss of the furnace refractory and wear of the discharging device can be drastically reduced.
2) Cleaning of the agglomerated raw material charging device, in which closure has frequently occurred, due to deformation and mutual adhesion becomes unnecessary, and the operation ratio can be improved.
3) Because the limitations on agglomeration can be drastically mitigated, the range of selection of agglomeration methods can be expanded and a agglomeration methods having a low cost and high efficiency can be selected.

The invention claimed is:

1. A raw material-feeding apparatus for a rotary hearth furnace, for feeding raw materials to a rotary hearth furnace by using a flat belt conveyor, characterized in that a scraper for guiding the raw materials on said flat belt conveyor to a side edge of said flat belt conveyor is arranged obliquely to a traveling direction of said flat belt conveyor, wherein the raw materials on said flat bed conveyor are fed to the rotary hearth furnace from the side edge of said flat belt conveyor, and wherein a cutoff plate is arranged downward from the carrier surface of the flat belt conveyor and adjustment projections are disposed on the surface of the scraper on which the raw materials flow.

2. A raw material-feeding apparatus for a rotary hearth furnace according to claim 1, wherein said scrapers for guiding the raw materials on said flat belt conveyor to the side edge of said flat belt conveyor are disposed on both sides of said flat belt conveyor and entrance positions of the scrapers where the raw material on the flat belt conveyor are guided to the side edge of the flat belt conveyor for falling on the rotary hearth furnace are arranged alternatively left and right.

3. A raw material-feeding apparatus f or a rotary hearth furnace according to claim 1, wherein a gap between entrance portions of said scraper for guiding the raw materials on said flat belt conveyor to the side edge of said flat belt conveyor is adjustable.

4. A raw material-feeding apparatus for a rotary hearth furnace according to claim 1, wherein said scraper for guiding the raw materials on said flat belt conveyor to the side edge of said flat belt conveyor is shaped into a curve shape.

5. A raw material-feeding apparatus for a rotary hearth furnace according to claim 1, wherein the raw materials are charged in one layer onto said flat belt conveyor.

6. A raw material-feeding apparatus for a rotary hearth furnace according to claim 1, wherein the raw materials are charged in two to five layers onto said flat belt conveyor.

* * * * *